US009016680B2

(12) United States Patent
Mutsuno

(10) Patent No.: US 9,016,680 B2
(45) Date of Patent: Apr. 28, 2015

(54) SHEET PROCESSING APPARATUS, CONTROL METHOD OF SHEET PROCESSING APPARATUS, AND PROGRAM

(71) Applicant: Canon Kabushiki Kaisha, Tokyo (JP)

(72) Inventor: Masahiro Mutsuno, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 26 days.

(21) Appl. No.: 13/900,930

(22) Filed: May 23, 2013

(65) Prior Publication Data

US 2013/0328258 A1 Dec. 12, 2013

(30) Foreign Application Priority Data

Jun. 7, 2012 (JP) ..... 2012-129549

(51) Int. Cl.

| | |
|---|---|
| ***B42B 4/00*** | (2006.01) |
| ***B65H 37/04*** | (2006.01) |
| ***B42C 1/12*** | (2006.01) |
| ***G03G 15/00*** | (2006.01) |

(52) U.S. Cl.

CPC *B42B 4/00* (2013.01); *B65H 37/04* (2013.01); *B42C 1/12* (2013.01); *G03G 15/6544* (2013.01); *G03G 2215/00822* (2013.01); *G03G 2215/00827* (2013.01); *G03G 2215/00877* (2013.01)

(58) Field of Classification Search

CPC ..... B65H 37/04; B42C 1/00; B42C 1/12; B31F 5/00; B31F 5/003; G03G 15/6544

USPC ..... 270/58.07, 58.08, 58.09, 58.11; 399/407, 408, 410

See application file for complete search history.

(56) References Cited

U.S. PATENT DOCUMENTS

| | | | | |
|---|---|---|---|---|
| 7,281,707 | B2 * | 10/2007 | Moriyama et al. | 270/58.04 |
| 7,410,158 | B2 * | 8/2008 | Iida et al. | 270/58.09 |
| 7,413,177 | B2 * | 8/2008 | Mori et al. | 270/58.09 |
| 7,497,427 | B2 * | 3/2009 | Ogushi et al. | 270/58.09 |
| 7,792,455 | B2 * | 9/2010 | Tao et al. | 399/85 |
| 8,074,976 | B2 * | 12/2011 | Ochi et al. | 270/58.09 |
| 8,177,214 | B2 * | 5/2012 | Sato | 270/58.09 |
| 8,398,353 | B2 * | 3/2013 | Mori | 412/14 |
| 2010/0149565 | A1 * | 6/2010 | Mori | 358/1.9 |
| 2011/0135366 | A1 * | 6/2011 | Asai et al. | 399/408 |

FOREIGN PATENT DOCUMENTS

| | | |
|---|---|---|
| JP | 2010-33071 A | 2/2010 |

* cited by examiner

*Primary Examiner* — Leslie A Nicholson, III

(74) *Attorney, Agent, or Firm* — Fitzpatrick, Cella, Harper & Scinto

(57) ABSTRACT

A mechanism capable of changing an upper limit number of sheets for a post-process is provided. To achieve this, a control method for controlling a sheet processing apparatus which performs the post-process for the sheets on which images are formed, comprising: storing, in a storage unit, the upper limit number of sheets to which the post-process can be performed; and changing the upper limit number of sheets stored in the storage unit is provided.

14 Claims, 7 Drawing Sheets

| KINDS OF SHEETS | BASIS WEIGHTS [gsm] |
|---|---|
| THIN PAPER | 52～63 |
| PLAIN PAPER | 64～90 |
| THICK PAPER | 91～105 |

SHEET PROCESSING APPARATUS, CONTROL METHOD OF SHEET PROCESSING APPARATUS, AND PROGRAM

BACKGROUND OF THE INVENTION

1. Field of the Invention

The present invention relates to a sheet processing apparatus which processes sheets (or paper sheets), a control method of the sheet processing apparatus, and a storage medium which stores therein a program for the control method.

2. Description of the Related Art

In regard to an image forming apparatus, a sheet processing apparatus which performs a post-process such as stapling, saddle stitch bookbinding, saddle stitch binding fold or the like as a function of a finisher has been proposed (Japanese Patent Application Laid-Open No. 2010-33071). Here, in the post-process, the upper limit number of sheets to which the post-process can be performed has been previously determined due to a mechanical limitation of the image forming apparatus.

As described in Japanese Patent Application Laid-Open No. 2010-33071, in a conventional sheet processing apparatus, the upper limit number of sheets for a post-process such as stapling or the like is fixedly determined.

More specifically, in the conventional sheet processing apparatus, it has been set to be able to perform a stapling process up to 60 sheets based on plain paper. However, although it may be possible to perform the stapling process at a time up to 80 sheets if paper having the thickness thinner than that of the plain paper is used, the stapling process could not be performed to 80 thin-paper sheets because such a kind of paper could not be handled. In recent years, kinds of sheets capable of being handled by the sheet processing apparatus have increased.

Incidentally, such a problem as above occurs not only in the stapling process but also in another post-process such as a folding process or the like.

SUMMARY OF THE INVENTION

The present invention has been completed to provide a mechanism which can change the upper limit number of sheets to which a post-process can be performed. To achieve the above object, the present invention provides a sheet processing apparatus which performs the post-process for the sheets on which images are formed, comprising: a storage unit configured to store the upper limit number of sheets to which the post-process can be performed; and a changing unit configured to change the upper limit number of sheets stored by the storage unit, on the basis of an instruction from a user.

Further features of the present invention will become apparent from the following description of exemplary embodiments with reference to the attached drawings.

DESCRIPTION OF THE EMBODIMENTS

Subsequently, exemplary embodiments of the present invention will be described with reference to the attached drawings.

<Description of System Constitution>

[First Embodiment]

Hereinafter, the first embodiment of the present invention will be described with reference to the attached drawings.

<Description of Image Forming Apparatus>

Figure 1:
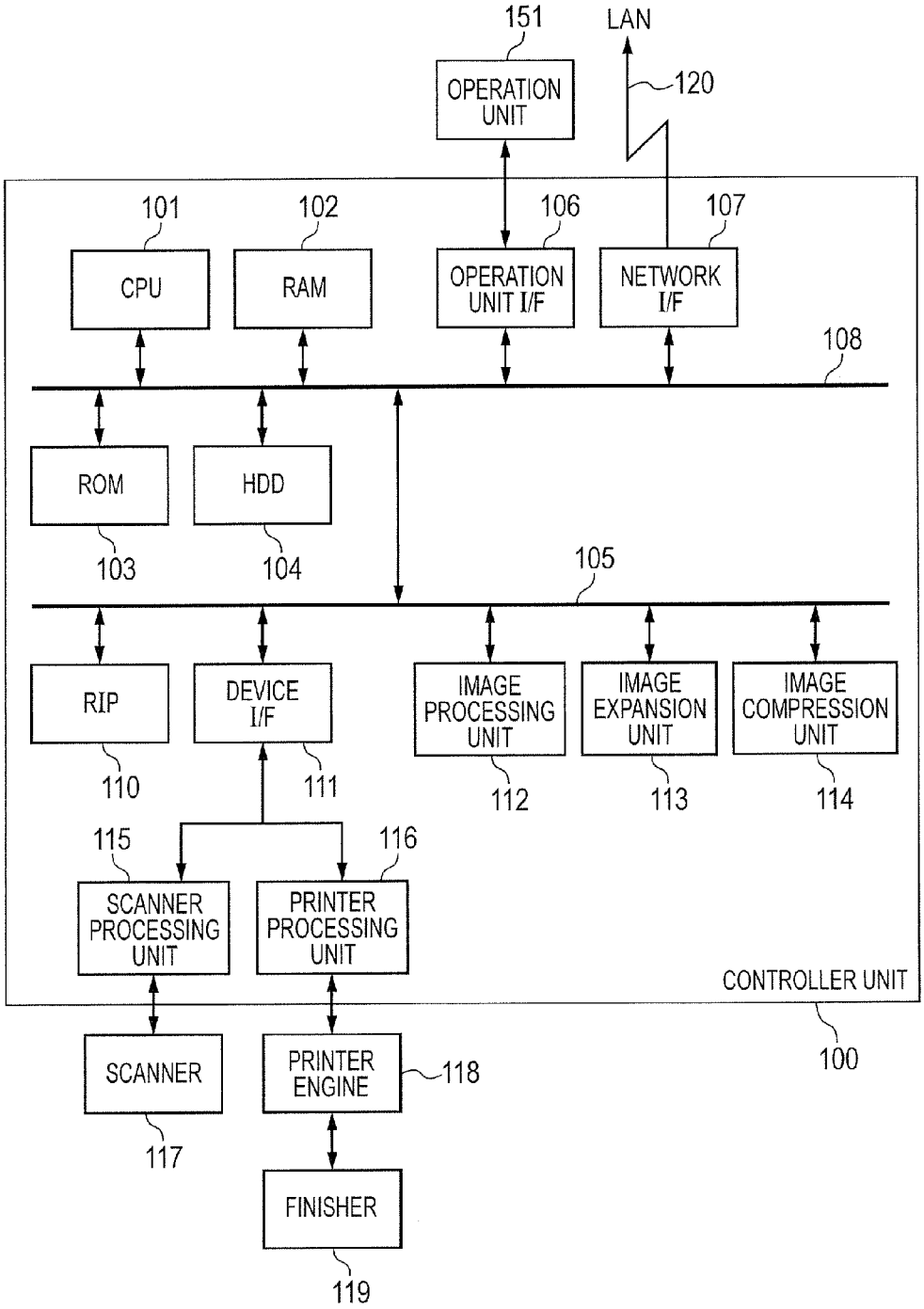
FIG. 1 is a block diagram illustrating an overall constitution of an image processing system to which a sheet processing apparatus according to the present invention is applied.

FIG. 1 is a block diagram illustrating an overall constitution of an image processing system to which a sheet processing apparatus according to the present embodiment is applied. The image processing system in the present embodiment includes an image forming apparatus, and the image forming apparatus is equipped with a controller unit 100 which controls the whole of the image forming apparatus, a scanner 117 which serves as an image input device, a printer engine 118 which serves as an image output device, and a finisher 119. Moreover, the image forming apparatus in the present embodiment is equipped with an operation unit 151 which is used to input an instruction from a user and display information to a user, and a scanner processing unit 115 which is connected to the scanner 117. The printer engine 118 is connected to the finisher 119, and is also connected to a printer processing unit 116. Incidentally, the scanner 117, the printer engine 118 and the operation unit 151 are respectively connected to the controller unit 100, and thus controlled in response to instructions from the controller unit 100.

In FIG. 1, the controller unit 100 includes a CPU (central processing unit) 101, and the CPU 101 is connected to a RAM (random access memory) 102, a ROM (read only memory) 103, an HDD (hard disk drive) 104, an image path I/F (interface) 105, an operation unit I/F 106 and a network I/F 107, through a system bus 108. The RAM 102 is a memory to be used to provide a working area for the CPU 101, and the RAM 102 is used as a setting value memory for temporarily storing parameter settings and an image memory for temporarily storing various image data. The ROM 103 is a boot ROM in which a system boot program has been stored, and the HDD 104 is a memory in which system software, a parameter setting value history, image data and the like have been stored.

The CPU 101 can read out the system boot program stored in the ROM 103 to the RAM 102, and then execute the read system boot program.

The operation unit I/F 106 is an interface to input and output various data between the controller unit and the operation unit 151. The operation unit I/F 106 outputs image data to be displayed to the operation unit 151 in response to an instruction from the CPU 101, and also the operation unit I/F 106 transfers the information input by a user through the operation unit 151 to the CPU 101.

The network I/F 107, which is connected to a LAN (local area network) 120, is used to input and output information from and to the LAN 120. An RIP (raster image processor) 110 is used to decompress a PDL (page description language) code received from the LAN 120 to a bitmap image.

When an image process to the image data is performed by the printer processing unit 116 and the processed image data is output by the printer engine 118, an image expansion unit 113 is used to decode and decompress the image data compressed, encoded and thus stored in the HDD 104. Further, when the image data processed by the RIP 110 or the scanner processing unit 115 is stored in the HDD 104, an image compression unit 114 is used to encode the image data in a predetermined compression manner.

A device I/F 111 is used to connect the scanner 117, the printer engine 118 and the finisher 119 to the controller unit through the scanner processing unit 115 and the printer processing unit 116 respectively, convert the image data synchronously and asynchronously, and further transfer a setting value, an adjusting value, and data of a device status. The scanner processing unit 115 performs various processes such as correction, edit, image separation, magnification change, binarization and the like to the image data input from the scanner 117.

The scanner 117, which comprises a platen reading device, reads an image of an original (or a copy). Further, the scanner 117 transports a plurality of originals, and can simultaneously read one side or two sides of the transported original by an ADF (automatic document feeder). Furthermore, the scanner comprises not-illustrated sensors for sensing whether or not the platen cover is being opened, sensing whether or not the original exists, and detecting the size of the original. Here, the detected information, status information indicating the status of the scanner 117, and the like are transmitted to the CPU 101 through the scanner processing unit 115 and the device I/F 111.

The printer processing unit 116 performs various processes such as correction, resolution conversion and the like to image data to be print-output in accordance with the printer engine 118, and also performs a process of adjusting a print position of the printed image. Further, the printer processing unit 116 performs a process of controlling the finisher 119 which performs various post-processes such as a stapling process, a punching process, a saddle stitch bookbinding process and the like in response to instructions issued by the CPU 101.

The printer engine 118 feeds sheets from a paper feeding cassette in which the sheets to be used for printing have been held, prints an image on each of the fed sheets, and discharges the sheets on which the images have been printed outside the image forming apparatus. A size sensor which detects a size of the held sheet is provided on the paper feeding cassette. The CPU 101 receives information indicating the size of the sheet detected by the size sensor, through the printer engine 118, the printer processing unit 116 and the device I/F 111. Further, the CPU 101 receives constitution information and status information of the finisher 119, device status information indicating the remaining quantity of the sheets held in each paper feeding cassette, an open/close status of each paper feeding cassette, and the like, through the printer processing unit 116 and the device I/F 111.

<Description of Software Module>

Figure 2:
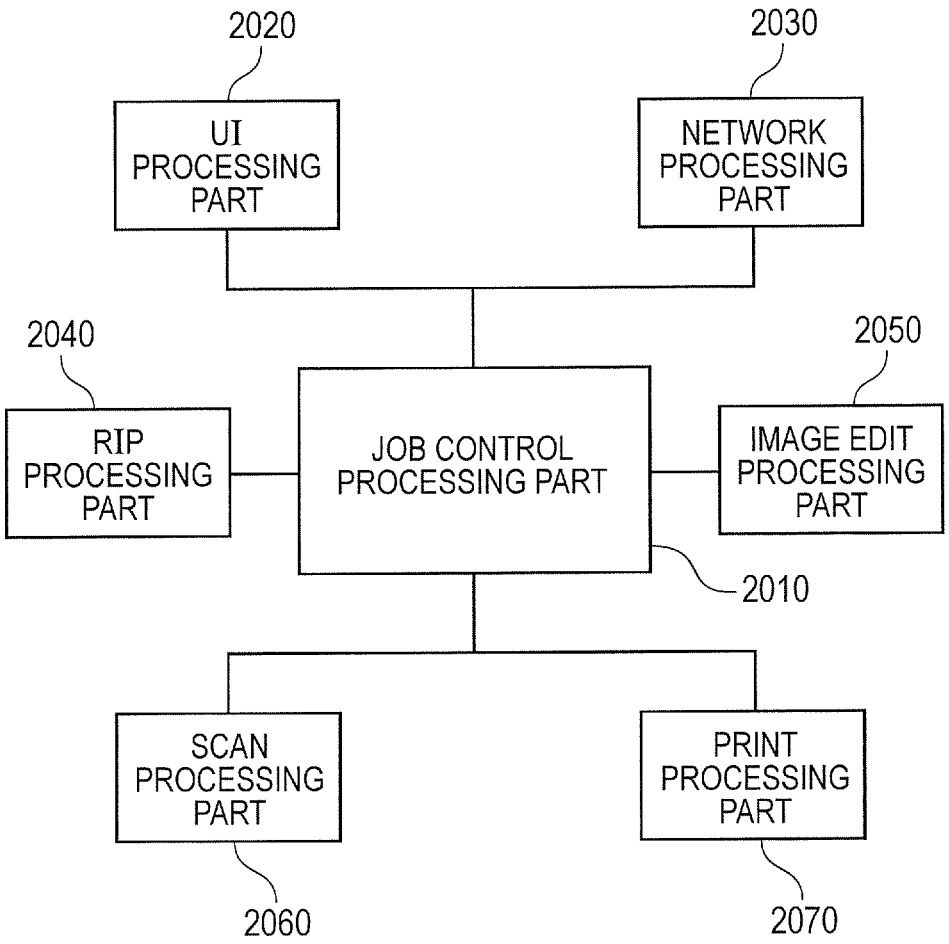
FIG. 2 is a block diagram illustrating a software module configuration of the image processing system.

FIG. 2 is a block diagram illustrating a software module configuration of the image processing system according to the present embodiment. Here, it should be noted that each software module illustrated here is mainly achieved when the CPU 101 reads out a corresponding program from the ROM 103 to the RAM 102, and executes the read program.

In FIG. 2, a job control processing part 2010 is a module which controls each of illustrated/not-illustrated software modules, and further controls all jobs such as a copy job, a print job, a scanning job, a UI process job and the like occurred in the image forming apparatus.

A UI processing part 2020 is a module which mainly controls the operation unit 151 and the operation unit I/F 106. More specifically, the UI processing part notifies the job control processing part 2010 of the contents of user's operation to the operation unit 151, and also controls the contents to be displayed on the display screen of the operation unit 151 in response to an instruction from the job control processing part 2010. Moreover, the UI processing part performs editing of drawing data to be displayed on the operation unit 151.

A network processing part 2030 is a module which mainly controls communication to be performed with external device through the network I/F 107. More specifically, the network processing part controls communication with each device on the LAN 120. When a control command or data from each device on the LAN 120 is received by the network processing part 2030, this part notifies the job control processing part 2010 of such a received content. Moreover, the network processing part transmits a control command or data to each device on the LAN 120 in response to an instruction from the job control processing part 2010.

An RIP processing part 2040 is a module which decompresses a PDL code to a bitmap image by interpreting the PDL code and performing rendering under the control of the RIP 110, in response to an instruction from the job control processing part 2010.

An image edit processing part 2050 is a module which performs an image process to a designated image by controlling an image processing unit 112, in response to an instruction from the job control processing part 2010. The image edit processing part 2050 accepts the image data or image information (image data size, color mode, resolution, etc.) from the job control processing part 2010. Further, the image edit processing part performs an appropriate image process to the image data by controlling the image processing unit 112, the image expansion unit 113 and the image compression unit 114, and then notifies the job control processing part 2010 of the image obtained after the image process.

A scan processing part 2060 is a module which instructs to read the original set on the scanner 117 by controlling the scanner 117 and the scanner processing unit 115 in response to an instruction from the job control processing part 2010. Then, the scan processing part instructs the scanner processing unit 115 to perform the image process to the read original image. Further, the scan processing part obtains the status information of the scanner processing unit 115 and the scanner 117, and notifies the job control processing part 2010 of the obtained status information.

A print processing part 2070 is a module which performs the designated image process and the designated print process by controlling the image processing unit 112, the printer processing unit 116 and the printer engine 118 in response to an instruction from the job control processing part 2010. Further, the print processing part 2070 accepts information such as the image data, image information (image data size, color mode, resolution, etc.), layout information (offset, enlargement/reduction, imposition, etc.), output paper information (size, print direction), and the like from the job control processing part 2010.

Further, the print processing part performs an appropriate image process to the image data by controlling the image expansion unit 113, the image compression unit 114, the image processing unit 112 and the printer processing unit 116, and instructs to perform printing to a print paper by controlling the printer engine 118.

Furthermore, the print processing part instructs to perform the printing to the print paper by controlling the printer processing unit 116 and the printer engine 118. The printer engine 118 controls the finisher 119 by sending an instruction from a not-illustrated device unit. CPU to the finisher 119, on the basis of the information received from the printer processing unit 116. Then, the print processing part obtains the status information of the printer processing unit 116, the printer engine 118 and the finisher 119, and notifies the job control processing part 2010 of the obtained information.

Figure 3:
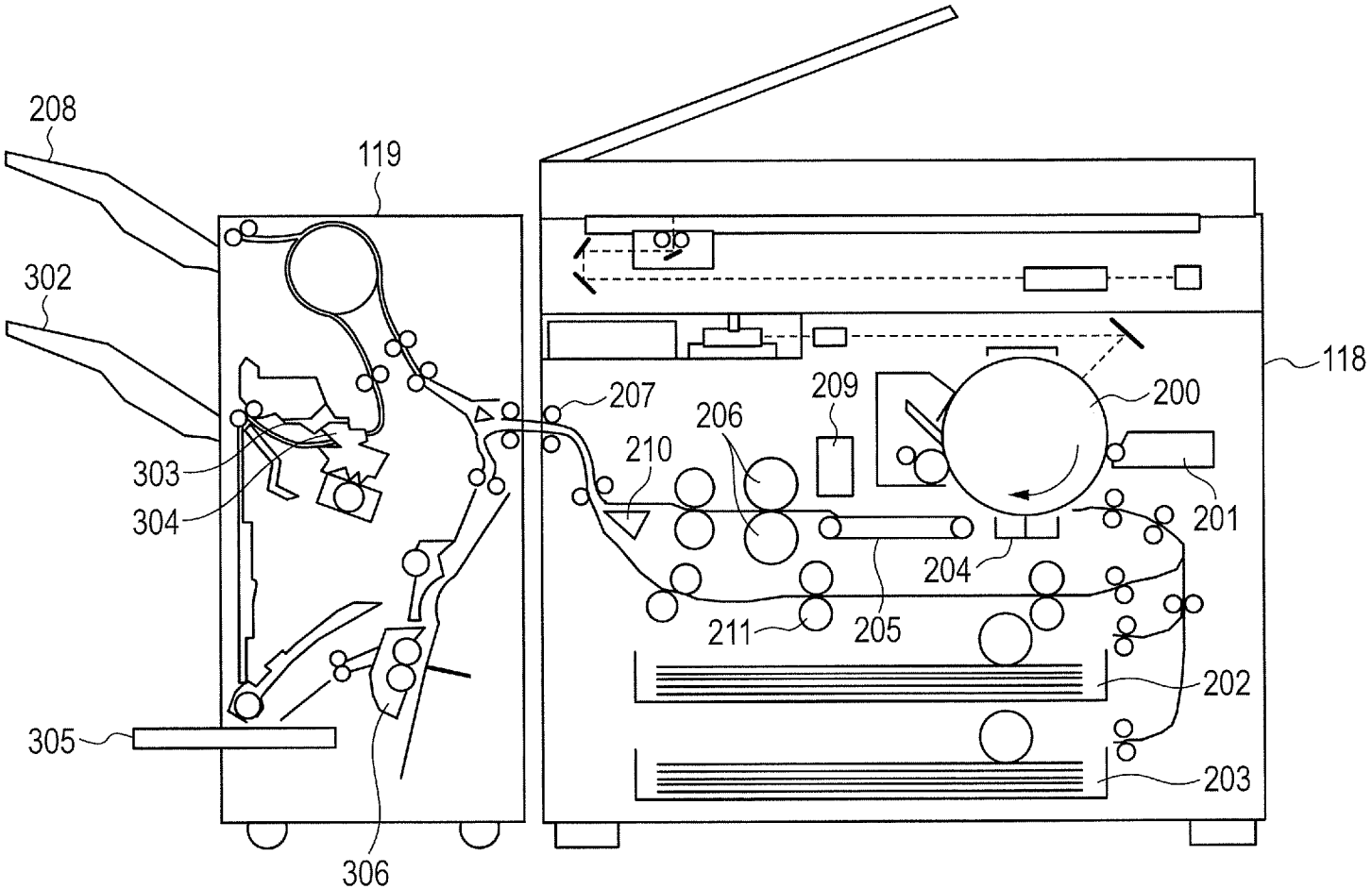
FIG. 3 is a cross section diagram illustrating an example of a constitution of a finisher in FIG. 1.

FIG. 3 is a cross section diagram illustrating an image processing apparatus which is an example of the sheet processing apparatus according to the present embodiment.

In FIG. 3, when a paper feed request is received from the CPU 101, the printer engine 118 determines whether or not a sheet (i.e., a paper sheet) necessary for printing exists in a paper feeding cassette 202 or a paper feeding cassette 203 and further determines whether or not the existing sheet can be fed. If it is judged that the sheet exists and can be fed, the CPU 101 controls to irradiate a laser beam to a photosensitive drum 200 according to print data, forms a latent image according to the print data, and applies a toner in a developer 201 to a latent-image portion on the photosensitive drum 200.

Then, the printer engine 118 feeds the sheet from the paper feeding cassette 202 or the paper feeding cassette 203, transports the fed sheet to a transfer unit 204, and transfers the toner applied to the photosensitive drum 200 to the transported sheet, in synchronization with the start of laser beam irradiation.

Further, the printer engine 118 transports the sheet on which the toner has been applied from an intermediate transfer belt 205 to a fixing unit 206, and fixes the toner to the sheet by heat and pressure in the fixing unit 206. The sheet which passed the fixing unit 206 is discharged by discharge rollers 207, and the sheet is actually discharged to a discharge tray 208 through the finisher 119. After the transfer operation, the printer engine 118 discharges the remaining toner on the photosensitive drum to a toner box 209.

Furthermore, in a case where two-sided printing has been designated in the print job, the printer engine 118 guides the sheet of which one side has been subjected to the printing and which has been transported until the discharge rollers 207 to a paper re-feed transportation path 211 through a flapper 210 by reversing the rotational direction of the discharge rollers 207. Then, the printer engine transports the relevant sheet from the paper re-feed transportation path 211 to the transfer unit 204.

Furthermore, the printer engine 118 transports the sheet of which the other side has been subjected to the printing, by the discharge rollers 207, and discharges the transported sheet to the discharge tray 208 through the finisher 119. Incidentally, in a case where paper feed is impossible, the printer engine 118 transmits a status indicating that the paper feed is impossible to the CPU 101, without performing the above operations for the latent image formation, the paper feeding, the sheet transportation, the image transfer and the image fixing.

In a case where a job in which a stapling process has been designated in the print setting is accepted by the image forming apparatus, the CPU 101 controls the finisher 119 to perform the stapling process to the recording sheets.

At that time, the CPU 101 controls to leave the sheets on an internal tray 303 of the finisher 119 until the number of sheets reaches the number set for the stapling process. Then, in a case where it is judged that the number of sheets left on the internal tray 303 reaches the number set for the stapling process, the CPU 101 instructs the finisher 119 to perform the stapling process. When the instruction of the stapling process is accepted, the finisher 119 controls a stapler 304 to perform the stapling process using staples to the sheets left on the internal tray 303, and then discharges a sheaf of the sheets stapled in the stapling process to the discharge tray 208.

The sheet processing apparatus in the present embodiment comprises a stack tray 302, the internal tray (or process tray) 303, the stapler 304, a booklet tray 305, and a saddle stitch bookbinding unit 306. Besides, the finisher 119 performs, in addition to the stapling process, post-processes (finishing processes) such as a saddle stitch binding process of binding the center of the sheets, folding the sheets into two and thus generating a book form, a nonbinding folding process of folding the sheets into two and generating a book form without binding the center of the sheets, and the like.

In the saddle stitch binding process, the CPU 101 controls the saddle stitch bookbinding unit 306 to bind the two points of the central portion of the sheets, and then fold the sheets into two by putting the central portion of the sheets in the roller. Then, the sheets which have been subjected to the bookbinding process by the saddle stitch bookbinding unit 306 are discharged to the booklet tray 305.

In the nonbinding folding process, the CPU 101 controls the saddle stitch bookbinding unit 306 to fold the sheets into two by putting the central portion of the sheets in the roller. Then, the folded sheets are discharged to the booklet tray 305.

Figure 4:
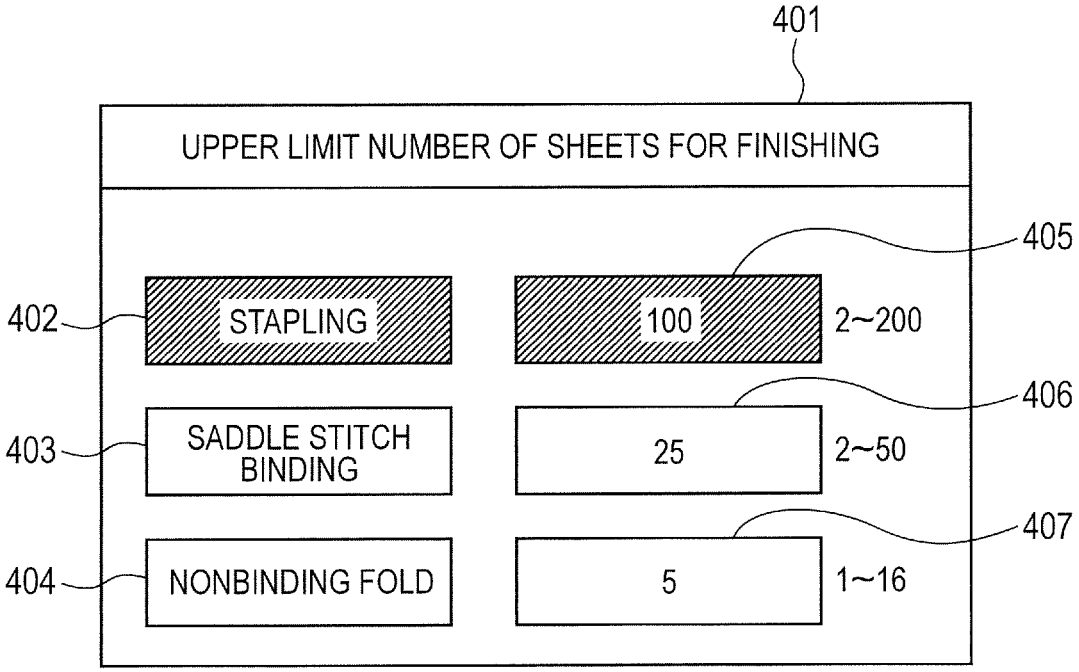
FIG. 4 is a diagram illustrating an example of a UI (user interface) to be used to perform setting for the sheet processing apparatus.

FIG. 4 is a diagram illustrating an example of a UI to be used to perform setting for the sheet processing apparatus according to the present embodiment. In the present embodiment, an operation screen 401 for setting the upper limit number of sheets for the finishing process function (stapling, saddle stitch binding, nonbinding fold) capable of being input is displayed on the display unit of the operation unit 151 illustrated in FIG. 1 is exemplarily shown.

In FIG. 4, in a section 402, the upper limit number of sheets to be subjected to the stapling can be set. More specifically, in a section 405, the number can be initially set within the range of "2" to "200" as the upper limit number of sheets.

In a section 403, the upper limit number of sheets to be subjected to the saddle stitch binding can be initially set. More specifically, in a section 406, the number can be set within the range of "2" to "50" as the upper limit number of sheets. In a section 404, the upper limit number of sheets to be subjected to the nonbinding fold can be initially set. More specifically, in a section 407, the number can be set within the range of "1" to "16" as the upper limit number of sheets. Here, the values indicated on the screen illustrated in FIG. 4 are the values each of which is suitable as the upper limit number of sheets for the post-process capable of being performed to plain paper by the image forming apparatus in the present embodiment. Namely, "100" is set as the upper limit number of sheets for the stapling process, "25" is set as the upper limit number of sheets for the saddle stitch binding process, and "5" is set as the upper limit number for the nonbinding fold. Incidentally, in the present embodiment, the setting range of the upper limit number of sheets is indicated by numerical values, so that numerical values other than the indicated numerical values are never set. Namely, even if a value which exceeds the indicated numerical value is input, it is controlled by the CPU 101 not to accept the relevant input value.

In the present embodiment, the upper limit number of sheets can be set for each of the plural kinds of processes such as the stapling process, the saddle stitch binding process, the nonbinding folding process and the like. Therefore, the user can change the upper limit number of sheets for each kind of post-process in consideration of the kind of sheets to be set to the paper feeding cassette 202 or the paper feeding cassette 203. For example, in a case where a sheet which is thinner than the plain sheet is set to the paper feeding cassette, the user can perform the stapling process to the sheaf of the sheets of which the upper limit number is larger than that of the plain paper by increasing the setting value of the upper limit value of sheets for the stapling process. Further, for each of the saddle stitch binding process and the nonbinding folding process, the user can set the upper limit number of sheets which is different from that for the staling process. For example, when the user sets the paper sheets each of which is thinner than the plain paper to the paper feeding cassette, it is possible to increase the upper limit number of sheets for the stapling process from "100" to "150", increase the upper limit number of sheets for the saddle stitch binding process from "25" to "40", and increase the upper limit number of sheets for the nonbinding folding process from "5" to "10". On the other hand, when the user sets the paper sheets each of which is thicker than the plain paper to the paper feeding cassette, it only has to reduce the upper limit number of sheets for the post-process.

Incidentally, in the status of the above setting, in a case where there are plural kinds of sheets to be set in received one job, when the upper limit numbers are different for the respective kinds of sheets, the CPU 101 may display on the operation unit 151 an alarm message indicating that the sheet process is impossible. Thus, it is possible to previously notify the user of the status that the sheet process to the sheaf of sheets becomes impossible in the job in which the plural kinds of sheets are used.

Figure 5:
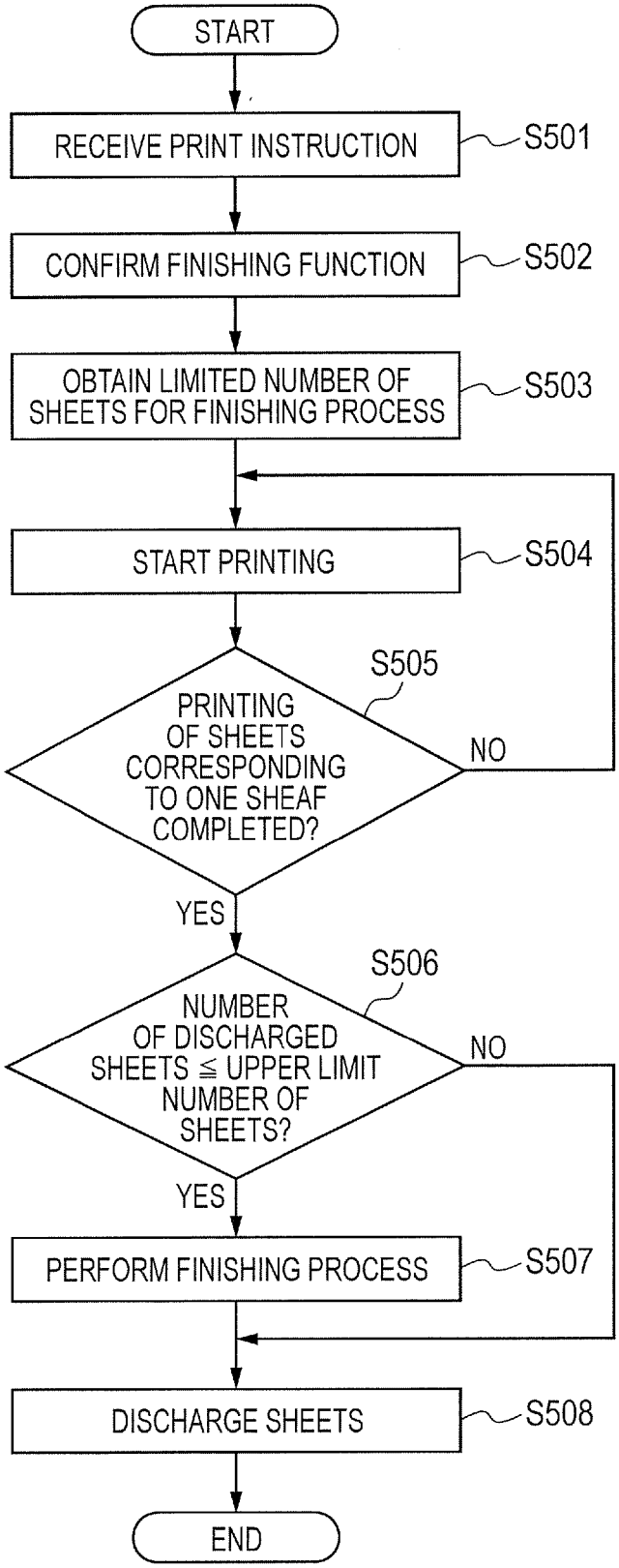
FIG. 5 is a flow chart for describing a control method of the sheet processing apparatus.

FIG. 5 is a flow chart for describing a control method of the sheet processing apparatus according to the present embodiment, and the flow chart shows an example of the print process which includes the sheet process to be performed when the upper limit number of sheets is input on the UI illustrated in FIG. 4. Incidentally, the process to be performed in each step is achieved on condition that the CPU 101 illustrated in FIG. 1 loads the modules illustrated in FIG. 2 to the RAM 102 and then executes the loaded modules. In the following, the controlling by the modules illustrated in FIG. 2 will be mainly described.

A print instruction from a printer driver installed in a not-illustrated information processing apparatus and a print instruction from the operation unit 151 are received through the LAN 120 by the job control processing part 2010 serving as the software module (S501). When the print instruction is accepted from the printer driver installed in the information processing apparatus, print data and the content of the print instruction (i.e., the print setting content) are transmitted from the information processing apparatus to the image processing apparatus. Further, when the print instruction is accepted from the operation unit 151, the image of the original is read by the scanner 117, and the read image of the original is obtained. In this case, the content of the print instruction (i.e., the print setting content) is accepted through the operation unit 151. Here, the content of the print instruction (i.e., print setting content) includes print resolution, print layout setting, post-process setting and the like.

From the print instruction received in S501, the content of the print instruction is analyzed by the job control processing part 2010, and finishing information (post-process information) such as stapling or the like is obtained from the analyzed content (S502). In the present embodiment, a case where a stapling instruction is included in the print instruction will be exemplarily described.

In S502, the job control processing part 2010 obtains the limited number of sheets (i.e., the upper limit number of sheets set based on the paper sheet normally used) for the finishing process stored through the UI illustrated in FIG. 4, on the basis of the obtained finishing information (S503). Then, the print processing part 2070 starts the print process in response to an instruction from the job control processing part 2010 (S504).

Next, the print processing part 2070 judges whether or not the printing of the sheets corresponding to one sheaf has been completed and the processed sheets have left on the internal tray 303 in the finisher 119 (S505). Here, it should be noted that the completion of the printing of the sheets corresponding to one sheaf is equivalent to completion of printing of prints corresponding to each finishing. For example, when the printing of the sheets corresponding to one copy is completed, it is judged whether the processed sheets have left on the tray. When the print processing part 2070 judges that the printing of the sheets corresponding to one sheaf is not completed, the print process is continuously performed.

On the other hand, when the print processing part 2070 judges in S505 that the printing of the sheets corresponding to one sheaf has been completed and the processed sheets have left on the internal tray 303, the print processing part further judges whether or not the number of discharged sheets is equal to or less than the upper limit number of sheets by comparing the upper limit number of sheets obtained in S503 and the number of discharged sheets with each other (S506). Incidentally, it should be noted that the number of discharged sheets is equivalent to the number of the sheets discharged on the internal tray 303, and the number of discharged sheets is counted by a sensor provided at the discharge port through which the sheets are discharged to the internal tray 303.

If it is judged in S506 that the number of discharged sheets is equal to or less than the upper limit number of sheets, the print processing part 2070 causes to perform the stapling process to the sheets left on the internal tray 303 (S507). Then, in S508, the print processing part 2070 causes to discharge the prints which have been subjected to the post-process to the stack tray 302.

On the other hand, if it is judged that the number of discharged sheets is larger than the upper limit number of sheets, the print processing part 2070 causes to discharge in S508 the sheets left on the internal tray 303 to the stack tray 302 without performing the stapling process to these sheets.

Incidentally, although the stapling process was exemplarily described as above in the present embodiment, the same process can be achieved even in the case where the saddle stitch binding process or the nonbinding folding process is performed. However, in the saddle stitch binding process or the nonbinding folding process, the process itself is different from that in the stapling process in the point that the sheets are left in the saddle stitch bookbinding unit 306 instead of the internal tray 303 and further the sheets are discharged to the booklet tray 305 instead of the stack tray 302.

According to the first embodiment, in the post-process which can be performed by the finisher 119, it is possible to freely set the upper limit number of sheets within the range between the settable upper and lower limits, and it is thus possible to perform the post-process according to the set upper limit number of sheets.

Thus, since the post-process corresponding to various kinds of output papers and sheets can be performed, it is possible to maximally use the performance of the finisher 119.

Incidentally, in the present embodiment, when the user changes the upper limit number of sheets for the post-process, the changed upper limit number of sheets is used irrespective of the kind of sheet to be used in the printing.

However, the present invention is not limited to this example. More specifically, the user may set the upper limit number of sheets of the post-process for each kind of sheet and store the set upper limit number in the HDD 104. Then, when the print instruction is accepted, the CPU 101 analyzes the content of the print instruction, and identifies the kind of sheet necessary for the printing and the kind of post-process. After then, the CPU 101 obtains from the HDD 104 the upper limit number of sheets which is determined based on the identified kind of sheet and the identified kind of post-process. Subsequently, it is judged by the CPU whether or not the number of sheets subjected to the printing process and left on the tray is equal to or less than the upper limit number of sheets. If it is judged that the number of sheets subjected to the printing process and left on the tray exceeds the upper limit number of sheets, the sheets are discharged without the post-process. On the other hand, if it is judged that the number of sheets subjected to the printing process and left on the tray is equal to or less than the upper limit number of sheets, the post-process is performed to the sheets, and then the processed sheets are discharged. Consequently, it is possible to perform the post-process with the suitable upper limit number of sheets for each kind of sheet, even if the user does not reset the upper limit value every time the kind of sheet is changed.

[Second Embodiment]

In the first embodiment, the sheet processing apparatus in which the upper limit number of sheets can be freely changed to the post-process of the finisher was described. In the second embodiment, an operation for each kind of sheet in a case where the limited number of sheets for the finishing process is set for, e.g., plain paper will be described.

In the present embodiment, since the system constitution of the image processing system including the sheet processing apparatus and the software module configuration thereof are the same as those in the first embodiment, the description thereof will be omitted. Also, in the present embodiment, the limited number of sheets for the finishing process is set by a user through the limited number setting screen (UI) illustrated in FIG. 4.

Figure 6:
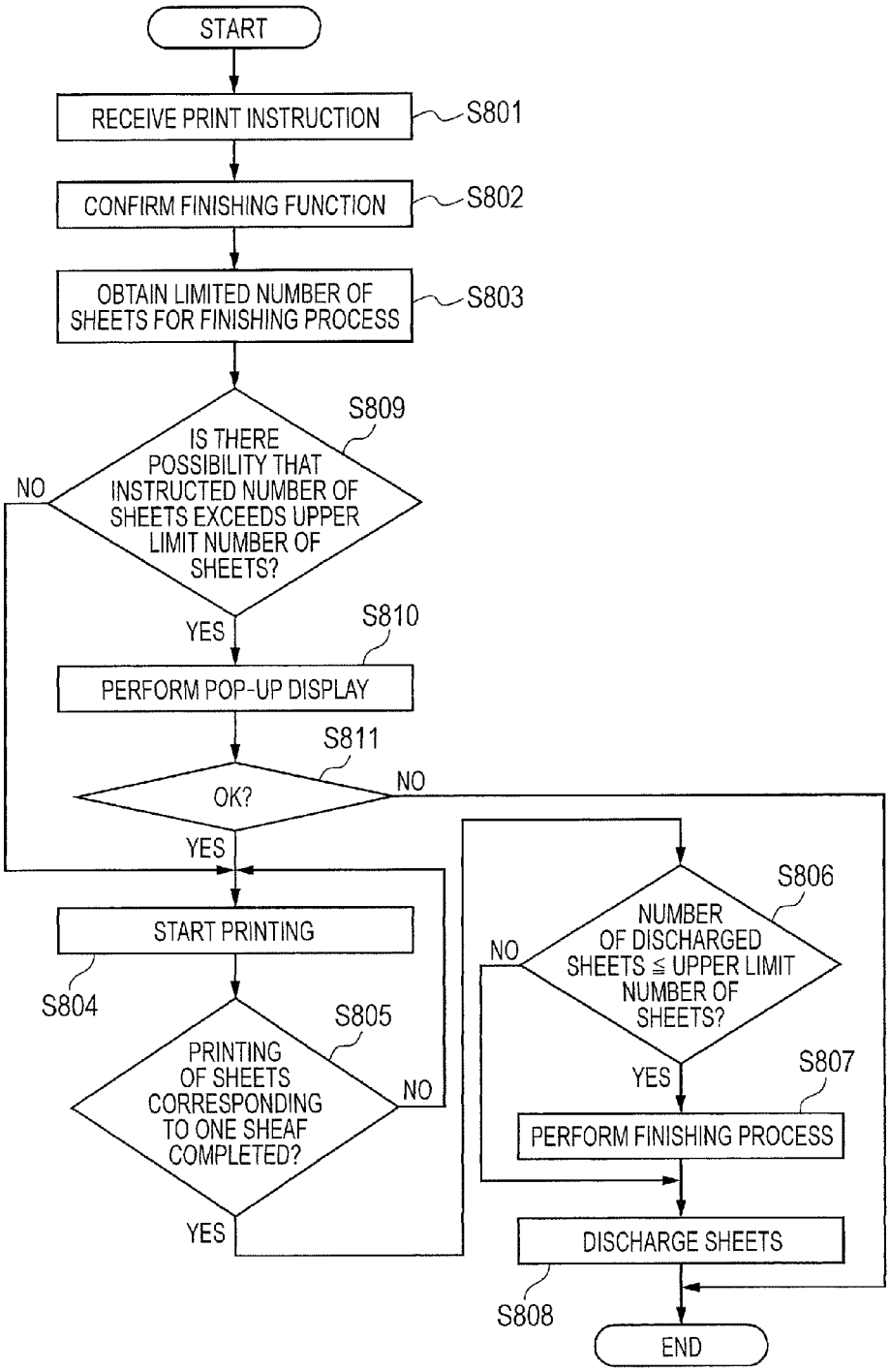
FIG. 6 is a flow chart for describing another control method of the sheet processing apparatus.

FIG. 6 is a flow chart for describing a control method of the sheet processing apparatus according to the present embodiment. In the present embodiment, an example of the print process including the sheet process to be performed when the upper limit number of sheets is input on the UI illustrated in FIG. 4 will be described. Incidentally, the process to be performed in each step of this flow chart is achieved on condition that the CPU 101 illustrated in FIG. 1 loads the modules illustrated in FIG. 2 to the RAM 102 and then executes the loaded modules. In the following, the controlling by the modules illustrated in FIG. 2 will be mainly described. In the present embodiment, it is assumed that the upper limit number of sheets for the finishing process has been set on the UI illustrated in FIG. 4 and, in the case of performing the sheet process, the kind of sheets for which the sheet-processable number is limited is selected.

A print instruction from the printer driver installed in a not-illustrated information processing apparatus through the LAN 120 and a print instruction from the operation unit 151 are received by the job control processing part 2010 serving as the software module (S801). When the print instruction is accepted from the printer driver installed in the information processing apparatus, the print data and the content (print setting content) of the print instruction are transmitted from the information processing apparatus to the image processing apparatus. Further, when the print instruction is accepted from the operation unit 151, an image of an original is read by the scanner 117, and the read image is obtained. In this case, the content (print setting content) of the print instruction is accepted through the operation unit 151. Here, the content (print setting content) of the print instruction includes print resolution, print layout setting, post-process setting and the like.

The job control processing part 2010 obtains the finishing information such as stapling or the like by analyzing the content of the print instruction (S802).

The job control processing part 2010 obtains the upper limit number of sheets suitable for each finishing process stored through the UI illustrated in FIG. 4, based on the finishing information obtained in S802 (S803).

Then, the job control processing part 2010 judges possibility that the instructed number of sheets exceeds the upper limit number of sheets by comparing the kind of sheet set based on the print instruction and the upper limit number of sheets for the finisher with each other (S809). Here, such a comparison process as above is performed by comparing a basis weight Wd (gsm) of the kind of sheet (e.g., plain paper) serving as the basis of the upper limit number of sheets previously determined by the limited number of sheets for the finisher input on the UI illustrated in FIG. 4 with a basis weight Wd of the kind of sheets designated based on the print instruction. Otherwise, the comparison process is performed by comparing an upper limit number Fd of the kind of sheet (e.g., plain paper) serving as the basis of the upper limit number of sheets with an upper limit number F set by the user and stored in the HDD 104.

Here, in a case where Ws>Wd and F>Fd, the upper limit number of sheets which is larger than that of the plain paper has been set although the basis weight of the sheet to be used in the printing is larger than the basis weight of the plain paper. For this reason, when the job control processing part 2010 judges the condition of Ws>Wd and F>Fd, the process advances to S810 because there is a possibility that the finishing process cannot be performed accurately. Namely, with reference to FIG. 7 indicating a relation between kinds of sheets and basis weights, the upper limit number of sheets for the finishing process is "100" in the section 405 on the basis of the plain paper, and it is assumed that the current setting value is "200".

Figures 7, 8:
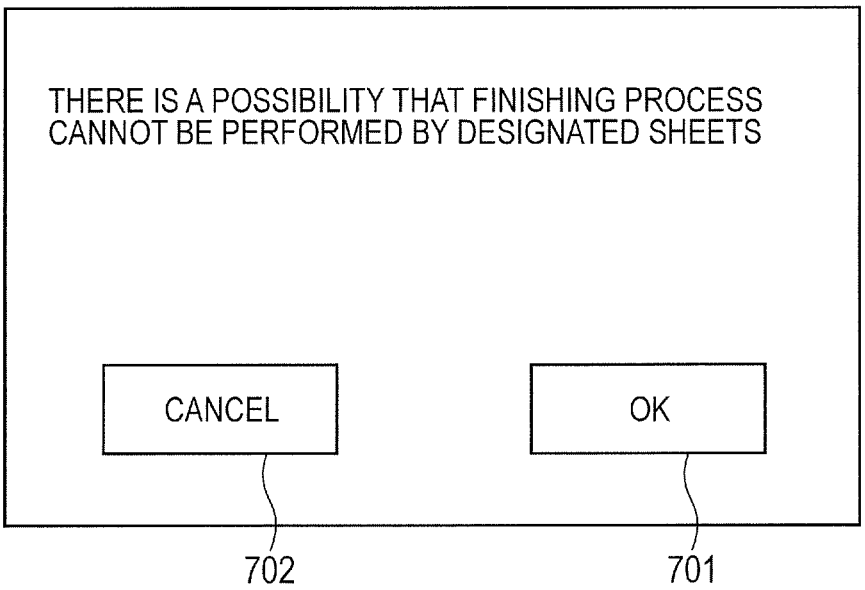
FIG. 7 is a diagram for describing a relation between kinds of sheets and basis weights.
FIG. 8 is a diagram illustrating an example of a UI to be used to perform setting for the sheet processing apparatus.

In a case where thick paper is selected by the user at the time of print designation, although the basis weight of the thick paper is higher than the basis weight of the plain paper as illustrated in FIG. 7, the upper limit number of sheets for the finishing process larger than the upper limit number of sheets suitable for the plain paper has been set. For this reason, the job control processing part 2010 judges that such a situation is NG, and the process advances to S810. On the other hand, if the job control processing part 2010 judges that the finishing process can be performed accurately, the process advances to S804.

The job control processing part 2010 displays the judged result of S809 indicating that the finishing process cannot be performed accurately, on the operation unit 151 through a user interface screen illustrated in FIG. 8 (S810).

Here, when the job control processing part 2010 judges that an OK button 701 is depressed by the user, the process advances to S804 to start the print process (S811). On the other hand, if the job control processing part 2010 judges that a CANCEL button 702 is depressed by the user, the printing based on the print instruction is stopped, and the process is completed.

In S804, the print processing part 2070 starts the print process in response to the instruction from the job control processing part 2010. The print processing part 2070 judges whether or not the sheets corresponding to one sheaf have been left on the internal tray 303 or the saddle stitch bookbinding unit 306 in the finisher 119 (S805). When the print processing part 2070 judges that the sheets corresponding to one sheaf are not left, the print process is continuously performed.

On the other hand, when the print processing part 2070 judges in S805 that the sheets corresponding to one sheaf have been left, the print processing part compares the number of discharged sheets with the upper limit number of sheets based on the upper limit number of sheets obtained in S803. Then, the print processing part 2070 judges whether or not the number of discharged sheets exceeds the upper limit number of sheets (S806). Incidentally, it should be noted that the number of discharged sheets is equivalent to the number of sheets discharged on the internal tray 303. The number of discharged sheets is counted by the sensor provided at the discharge port through which the sheets are discharged to the internal tray 303.

When the print processing part 2070 judges in 5806 that the number of discharged sheets is equal to or less than the upper limit number of sheets, the print processing part 2070 causes the finisher 119 to perform the post-process (S807). Then, in S808, the print processing part 2070 causes to discharge the prints which have been subjected to the post-process to the stack tray 302.

On the other hand, when the print processing part judges that the number of discharged sheets is larger than the upper limit number of sheets, the print processing part 2070 causes in S808 to discharge the sheets to the stack tray 302 without performing the stapling process to the sheets left on the internal tray 303 (S808).

According to the image forming apparatus in the second embodiment, it is possible, in the finishing process which can be performed by the finisher 119, to inform the user that the finishing process becomes impossible due to the problem of the upper limit number of sheets.

Thus, since it is possible for the user to previously know whether or not the finishing process can be performed, it is possible to maximally use the performance of the finisher 119.

Incidentally, according to the present embodiment, since the pop-up message of S810 can be displayed based on the basis weight of the sheets and the kind of post-process, it is unnecessary to identify the number of sheets to be actually subjected to the printing based on the print instruction. For this reason, since it is unnecessary to count the number of pages included in the print data to identify the number of prints, it is possible to prevent that the start of the printing is delayed.

Moreover, in the present embodiment, the print job in which the print instruction from the printer driver installed in the information processing apparatus and the print data are received and accepted and the printing is performed and the copy job in which the print instruction from the operation unit 151 is received and accepted and the printing is performed have been exemplarily described.

However, the present embodiment is also applicable to a box job in which a print instruction is received and accepted to print data previously stored in the HDD 104 and printing is performed based on the relevant print data.

[Other Embodiments]

Aspects of the present invention can also be realized by a computer of a system or apparatus (or devices such as a CPU or MPU) that reads out and executes a program recorded on a memory device to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-129549, filed Jun. 7, 2012, which is hereby incorporated by reference herein in its entirety.

What is claimed is:

1. A sheet processing apparatus which performs a stapling process for sheets on which images are formed, comprising:

a setting unit configured to accept an input of a numerical value by a user, and set the input numerical value as an upper limit number of sheets to which the stapling process can be performed; and a display unit configured to, when the setting unit accepts the input of the numerical value by the user, display a settable upper limit and a settable lower limit, wherein the setting unit sets the upper limit number of sheets within a range of the settable upper limit and the settable lower limit.

2. The sheet processing apparatus according to claim 1, wherein the setting unit sets the upper limit number of sheets based on a kind of stapling process.

3. The sheet processing apparatus according to claim 1, wherein the setting unit sets the upper limit number of sheets to which the stapling process can be performed based on a kind of sheet.

4. The sheet processing apparatus according to claim 3, further comprising:

a determining unit configured to determine whether or not the stapling process to the sheets of which the number exceeds the upper limit number of sheets has been requested, before the job is performed, wherein, in a case where it is determined by the determining unit that the stapling process to the sheets of which the number exceeds the upper limit number of sheets has been requested, the display unit further displays the sheet stapling process which cannot be performed.

5. The sheet processing apparatus according to claim 1, wherein the setting unit sets the upper limit number of sheets to which the stapling process can be performed for each kind of sheet to be fed.

6. A control method for controlling a sheet processing apparatus which performs a stapling process for sheets on which images are formed, the method comprising:

accepting an input of a numerical value by a user, and setting the input numerical value as an upper limit number of sheets to which the stapling process can be performed; and when the input of the numerical value by the user is accepted, displaying a settable upper limit and a settable lower limit, wherein the upper limit number of sheets is set within a range of the settable upper limit and the settable lower limit.

7. A non-transitory computer readable storage medium for storing a computer program to control a sheet processing apparatus which performs a stapling process for sheets on which images are formed, the computer program comprising:

a code to accept an input of a numerical value by a user, and set the input numerical value as an upper limit number of sheets to which the stapling process can be performed; and a code to, when the input of the numerical value by the user is accepted, display a settable upper limit and a settable lower limit, wherein the upper limit number of sheets is set within a range of the settable upper limit and the settable lower limit.

8. A sheet processing apparatus which performs a post-process including plural sheet processes for sheets on which images are formed, comprising:

a setting unit configured to accept an input of a numerical value by a user for each of the plural sheet processes, and set the input numerical value as an upper limit number of sheets for each of the plural sheet processes to which the sheet process can be performed; and a display unit configured to display settable upper limit and settable lower limit for each of the plural sheet processes when the setting unit accepts the input of the numerical value by the user, wherein the setting unit sets the upper limit number of each of the plural sheet processes within a range of the settable upper limit and the settable lower limit.

9. The sheet processing apparatus according to claim 8, wherein the setting unit sets the upper limit number of each of the plural sheet processes to which the sheet process can be performed, on the basis of a kind of sheets.

10. The sheet processing apparatus according to claim 8, further comprising:

a determining unit configured to determine whether or not the sheet process to the sheets of which the number exceeds the upper limit number of each of the plural sheet processes has been requested, before the job is performed, wherein the display unit further configured to, in a case where it is determined by the determining unit that the sheet process to the sheets of which the number exceeds the upper limit number of each of the plural sheet processes has been requested, display the sheet process which cannot be performed.

11. The sheet processing apparatus according to claim 8, wherein the setting unit sets the upper limit number of each of the plural sheet processes to which the sheet process can be performed, for each kind of sheets to be fed.

12. The sheet processing apparatus according to claim 8, wherein the sheet process includes at least a stapling process, a saddle stitch binding process and a nonbinding folding process.

13. A control method for controlling a sheet processing apparatus which performs a post-process including plural sheet processes for sheets on which images are formed, the method comprising:

accepting an input of a numerical value by a user for each of the plural sheet processes, and setting the input numerical value as an upper limit number of each of the plural sheet processes to which the sheet process can be performed; and displaying a settable upper limit and a settable lower limit for each of the plural sheet processes when the input of the numerical value by the user is accepted, wherein the upper limit number of each of the plural sheet processes is set within a range of the settable upper limit and the settable lower limit.

14. A non-transitory computer readable storage medium for storing a computer program to control a sheet processing apparatus which performs a post-process including plural sheet processes for sheets on which images are formed, the computer program comprising:

a code to accept an input of a numerical value by a user for each of the plural sheet processes, and set the input numerical value as an upper limit number of each of the plural sheet processes to which the sheet process can be performed; and a code to display settable upper limit and settable lower limit for each of the plural sheet processes when the input of the numerical value by the user is accepted, wherein the upper limit number of each of the plural sheet processes is set within a range of the settable upper limit and the settable lower limit.

* * * * *